United States Patent [19]

Oida et al.

[11] Patent Number: 4,716,341

[45] Date of Patent: Dec. 29, 1987

[54] DISPLAY DEVICE

[75] Inventors: Osamu Oida; Tsunekiyo Iwakawa, both of Tokyo, Japan

[73] Assignee: NEC Corporation, Japan

[21] Appl. No.: 816,801

[22] Filed: Jan. 7, 1986

[30] Foreign Application Priority Data

Jan. 7, 1985 [JP] Japan ..... 60-572

[51] Int. Cl.[4] ..... G09G 3/10

[52] U.S. Cl. ..... 315/169.4; 315/169.1; 313/583; 340/811

[58] Field of Search ..... 340/652, 550, 811, 715; 200/61.08; 315/169.1, 169.4; 313/583

[56] References Cited

U.S. PATENT DOCUMENTS

| | | | |
|---|---|---|---|
| 1,468,328 | 9/1923 | Roe | 340/550 |
| 3,524,920 | 8/1970 | Stromquist et al. | 200/61.08 |
| 3,559,190 | 1/1971 | Bitzer et al. | 315/169 X |
| 3,706,892 | 12/1972 | O'Brien | 315/169.4 |
| 4,242,677 | 12/1980 | Jonath | 340/715 |
| 4,367,460 | 1/1983 | Hodara | 340/550 |

*Primary Examiner*—Harold Dixon

*Attorney, Agent, or Firm*—Laff, Whitesel, Conte & Saret

[57] ABSTRACT

A display device which is driven by a high driving voltage, has a display panel with display electrodes. A conductor line extends along the surface of the display panel. A high voltage producing means is connected to one end of the conductor line for applying a high voltage to the display electrodes. A low voltage source is connected to the other end of the conductor line for operating the high voltage producing means. Thus, an application of the high voltage to the display electrodes is terminated when the conductor line is broken or cut as a result of damage to the display panel.

10 Claims, 4 Drawing Figures

DISPLAY DEVICE

BACKGROUND OF THE INVENTION

This invention relates to display devices operated with a high driving voltage, such as a plasma display or an electroluminescence display, and more particularly, to improvement in the safety of such display devices.

The importance of display devices as a man-machine interface has increasingly been recognized in recent years along with the development of office automation and factory automation systems. Flat display devices, such as liquid crystal display, plasma display and electroluminescence (EL) devices are expected to play a significant role as compact flat displays of higher display quality.

Since the liquid crystal display is driven with low voltages of two to five volts, electrocution accidents do not occur. In contrast, plasma displays or ELs are driven with relatively high voltages of ninety to two-hundred fifty volts. Therefore, electrocution accidents might occur if electrodes are exposed during operation when there is damage in the panel and if operators accidentally make contact with the high voltage electrodes. To cope with such accidents, prior art panels are provided with a protection plate which is positioned in front of the display panel, so as not to be damaged easily. However, the addition of such a protection plate causes a deterioration of the resolution of the display and the display device becomes bulky.

An object of this invention is to provide a display device which is highly safe and yet has an excellent display quality.

The display device, according to this invention, comprises a display panel having electrodes for display. A conductor line is provided on the display panel in a position which does not disturb the display pattern. A low voltage source is connected to one end of the conductor line, and a driving circuit of the display panel is connected to the other end of the conductor line. The operation of the driving circuit stops when the display panel is damaged or the conductor line is broken. A stopping of the drive circuit suspends the supply of all high driving voltage, toward the electrodes for the display.

Figure 1A:
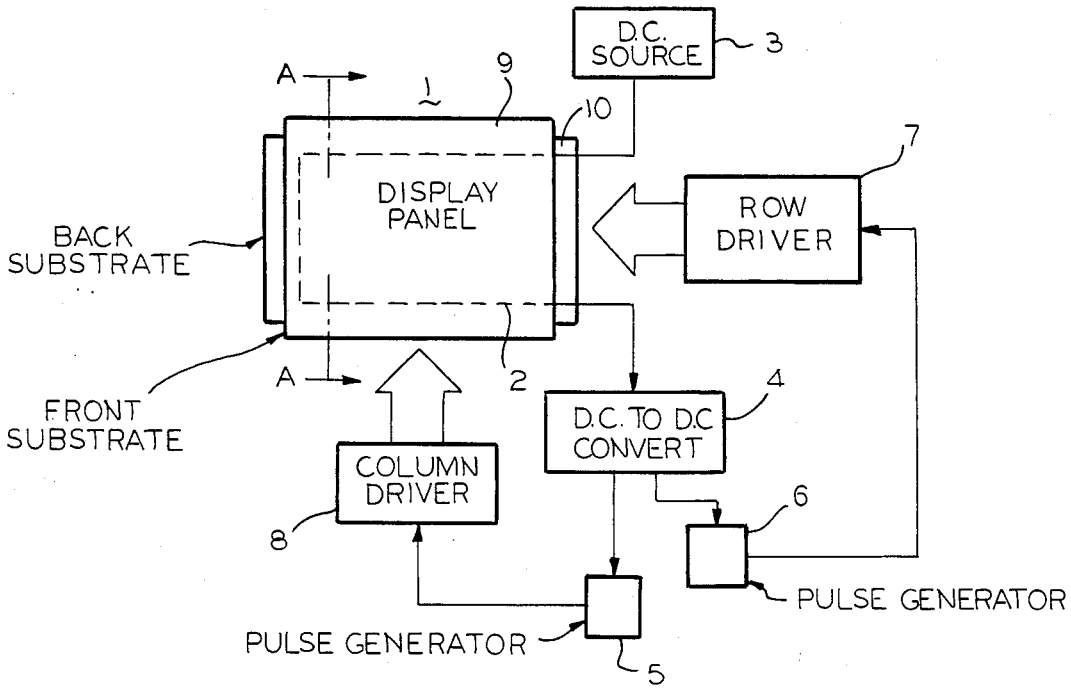
FIG. 1A is a block diagram of the first embodiment of the display device according to this invention.
Figure 1B:
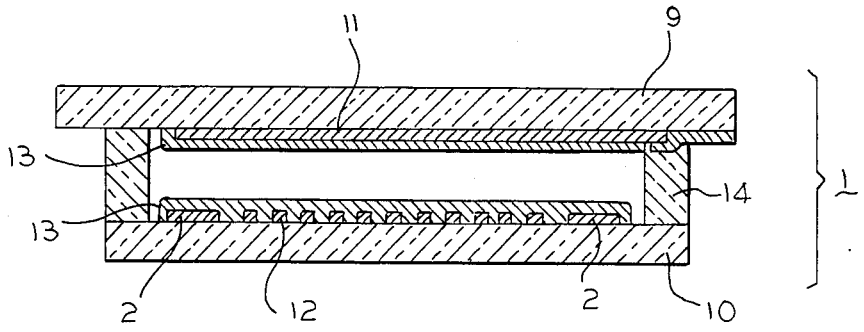
FIG. 1B is a cross sectional view of the display panel shown in FIG. 1A, the section being taken along the A—A line of FIG. 1A.

DESCRIPTION OF THE PREFERRED EMBODIMENTS:

Referring to FIG. 1A and FIG. 1B, display panel 1 comprises a front substrate 9 and back substrate 10 which are spaced apart from each other by a spacer means 14. A plurality of transparent first electrodes 11 are formed on the inner surface of the front substrate 9 and are opposed to a plurality of second electrodes 12 formed on the inner surface of the back substrate 10. In this embodiment, an X-Y dot matrix-type plasma display device is shown. Thus, the first electrodes 11 are parallel to each other and are perpendicular to the second electrodes 12. These electrodes 11 and 12 are coated with insulative layers 13, respectively. Neon gas is used as a luminous medium and is sealed inside the panel to provide a so-called "AC-tye plasma display panel."

A conductor line 2 is formed on the inner surface of the back substrate to surround the second electrodes 12. One end of the conductor line 2 is connected to a low DC voltage source 3 and the other end thereof is connected to a DC-DC converter 4. Thus, the low voltage which is fed from the DC voltage source 3 is supplied via the conductor line 2 to a DC-DC converter 4, which converts the low voltage DC to a high DC voltage. The voltage which is converted by the DC-DC converter 4 into a voltage which is high enough to drive the display panel (e.g. 150 V) is fed to pulse generators 5 and 6 which generate high voltage pulses of opposite phases, repsectively.

The output high voltage pulses from the pulse generator 5 are supplied to row driver 7 which drives row electrodes of the display panel. On the other hand, the output high voltage pulses from the pulse generator 6, are fed to column driver 8 which drive column electrodes of the display panel. The row driver 7 sequentially provides output selection voltage pulses which are applied to the row electrodes of the display panel 1. The column driver 8 provides output selection voltage pulses corresponding to data which is applied to the column electrodes of the display panel 1 in order to display selected discharge cells.

When the display panel 1 is broken, for any reason, the conductor line 2 is cut or broken and the input to the DC-DC converter 4 is suspended, to thereby suspend the high voltage pulses which are being supplied to the electrodes of the display panel 1. Therefore, the display device according to this invention can eliminate the possibility of giving electrical shocks, even if someone comes into contact with exposed display electrodes of the broken panel.

When the number of electrodes is increased to obtain a high display density in the X-Y dot matrix type of display panel, it is inevitably necessary to drive the electrodes from opposite end portions of each substrate.

Figure 2:
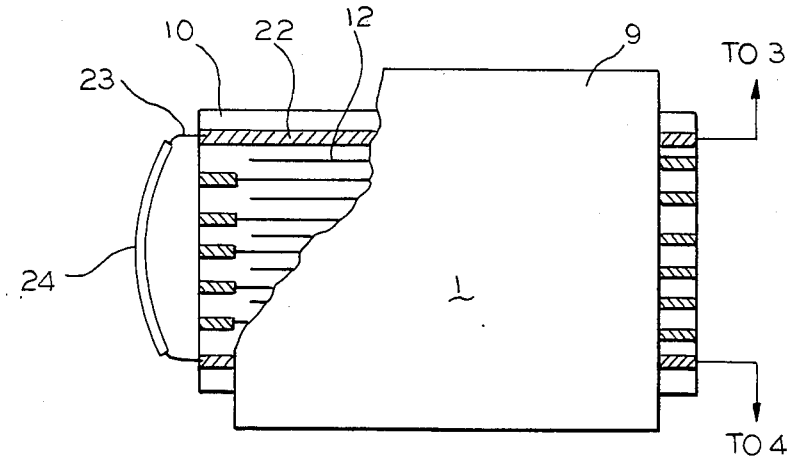
FIG. 2 is a partially broken plan view of the second embodiment of a display panel according to this invention.

Referring to FIG. 2, the second electrodes 12 are alternately connected to be energized from the opposite sides or ends of the back substrate 10. In such a display panel, the U-shaped conductor line 2, shown in FIG. 1, cannot be applied directly to the inner surface of the substrate.

To this end, in FIG. 2, the two conductor lines 22 are arranged on the upper and lower sides of the display panel 1 and are connected in series, outside of the panel by using an external wire, such as copper wire 23. One of the electrodes in this series circuit is supplied with a low voltage from a low voltage source 3, while the other electrode is connected to the input of the DC-DC converter 4. According to this embodiment, a possible short circuit between second electrodes 12 and the conductor lines 22 can be easily avoided by using an external wire 23 which is coated with insulative sleeve 24.

In the above-described embodiments, the conductor line 2 or 22 can be formed by using a conventional screen printing technique which is used to form the second electrodes 12. Therefore, no additional special process is required for making the conductor line 2 or 22.

In these embodiments, the significant point is that the conductor line 2 should be provided so as not to disturb the display pattern. In other words, the conductor lines should be formed outside the region of the electrodes 12.

Figure 3:
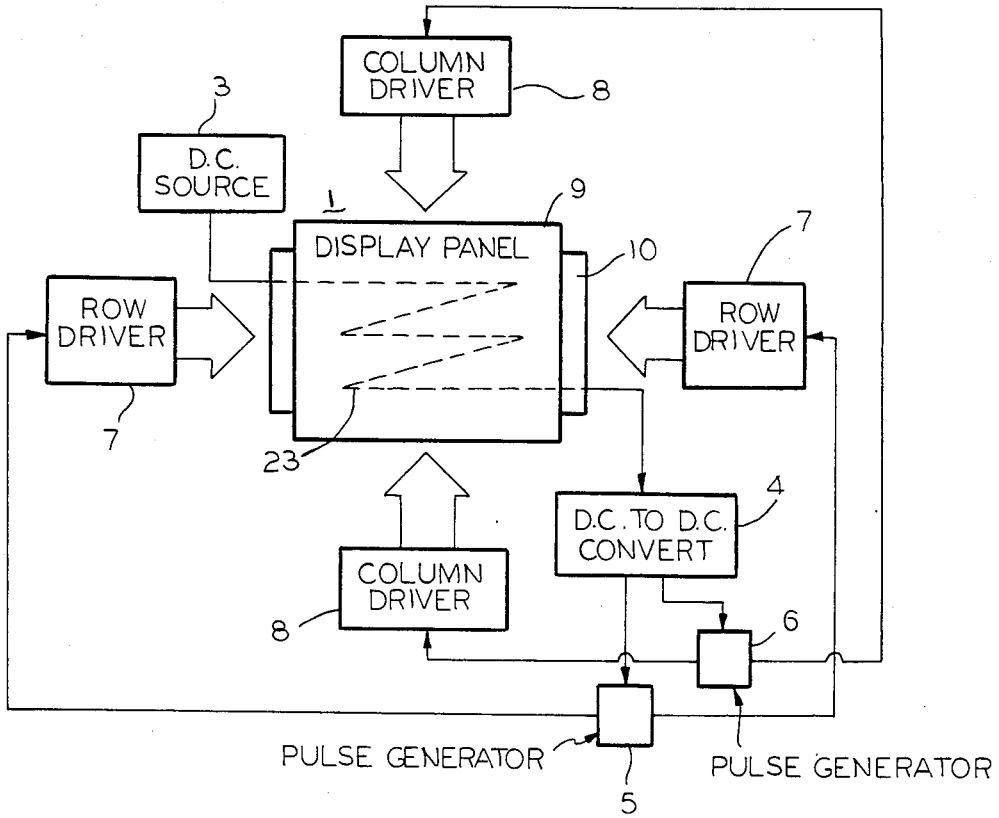
FIG. 3 is a block diagram of the third embodiment of the display device according to this invention.

In order to avoid such a restriction, it is possible to provide the conductor line on the outer surface of the back substrate 10 as shown in FIG. 3.

In a block diagram shown in FIG. 3, the elements which are the same as those in FIG. 1 are denoted with the same reference numerals. A conductor line 23 is formed by, for example, screen printing silver paste on and across the outer surface of the back substrate 10, the printing being in a zigzagging pattern. The low voltage fed from the DC voltage source 3 is supplied via the conductor line 23 to a DC-DC converter 4 which converts the low voltage to DC high voltage. The voltage which is converted by the DC-DC converter 4 to a voltage high enough to drive the display panel is fed to pulse generators 5 and 6 which generate high voltage pulses of opposite phases, respectively. Since the electrodes are positioned on both sides of the substrate ends, the high voltage output pulses from the pulse generator 5 are supplied to a pair of column drivers 7, 7. The high voltage output pulses from the pulse generator 6, on the other hand, are fed to a pair of row drivers 8, 8.

In the foregoing embodiments, although the conductor line is provided on the back substrate, it is possible to form the conductor line on the front substrate of the display panel. An appropriate pattern of the conductor line is the same as the patterns shown in FIG. 1 or FIG. 2. If the conductor line is on either the inner surface or the outer surface of the front substrate, transparent material, such as $SnO_2$ is not appropriate due to its high resistivity. Then, the silver paste is an appropriate material even in the front substrate. A silver paste screen printing process using silver paste is used to form a terminal portion of every transparent electrodes 11 made of a material, such as $SnO_2$, so as to facilitate a use of solder to make the connections between external lead wires and the transparent electrodes 11.

In view of the manufacturing process, it is preferable to form the conductor line on the inner surface of either the front substrate or the back substrate. This is because the screen printing process may be used for making electrodes for display at the same time and no other additional process is required.

Needless to say, this invention is not restricted to the AC-type plasma display, but can be applied to any other type of display panels driven by high driving voltage, such as DC-type plasma display panels and EL display panels.

As for the electroluminescence display panel, the well known basic structure is such that a transparent first electrode, a first insulative layer, a fluorescent material layer as a luminous medium, a second insulative layer and a second electrode are consecutively formed on a transparent substrate. Therefore, the conductor line can be formed on either the inner surface or the outer surface of the transparent substrate so as not to disturb the display pattern.

In a plasma display panel, there are other types of display panels called a surface discharge type in which a discharge occurs between a pair of electrodes formed on the same substrate. In this type of structure, therefore, the envelope of the display panel includes a non-electrode substrate. Accordingly, the conductor line of the present invention can be formed on the non-electrode substrate, rather than on the substrate having electrodes for display.

As is apparent from the foregoing, this invention can be applied to any type of display panels. When the conductor line becomes very long, as shown in FIG. 3, the conductor line should be designed in such a way that the voltage drop in the conductor line should be 0.5 ohms, or less. For example, if the conductor line is made of screen printed silver and is designed to have the length of 1,000 mm, a width of 10 mm, and a thickness of 10 μm, the total resistance of the printed conductor line in a zigzagging pattern becomes less than 0.5 ohms. In the embodiment shown in FIG. 2, the total length of the conductor lines 22 is short, e.g. 400 mm; the width of each conductor line 22 can be about 5 mm.

As described in the foregoing specification, this invention can provide a very safe display device which does not need an additional protection plate to prevent electrification accidents. Such accidents can be prevented even if the panel is unexpectedly broken during operation to expose electrodes because the conductor line provided across the panel substrates also breaks. As the display device, according to this invention, is adapted to have the front substrate surface of the display panel treated directly against reflection, it can solve the problem of deterioration in resolution which might be caused in the prior art devices using additional protection plates.

This invention is not limited to the circuit structures shown in the described embodiments, but may naturally include all the other similar circuit structures so far as the high voltage thereof can be substantially suspended. For example, a low DC voltage source can be changed to a low AC voltage source; a DC-DC converter can be changed to a DC-AC converter. The arrangement of conductors is not limited to the described pattern, but may include all the other suitable patterns, so far as they traverse the panel substrates.

When the display device according to this invention is used for an automobile's indicating panel, a car battery (twelve to fifteen volts) is used for the low DC voltage source of this invention. If a car accident should occur, the driver can be protected from electrification by the display panel. To avoid an electrification shock, the voltage of the low voltage source is selected so as not to exceed approximately thirty volts.

Those who are skilled in the art will readily perceive how to modify the invention. Therefore, the appended claims are to be construed to cover all equivalent structures which fall within the true scope and spirit of the invention.

What is claimed is:

1. A display device driven by a high driving voltage comprising:

a display panel having display electrodes;

a conductor line provided on the surface of said display panel;

a high voltage producing means connected to one end of said conductor line for applying a high voltage to said display electrodes; and a low voltage source connected to the other end of said conductor line for operating said high voltage producing means, whereby an application of said high voltage to said display electrodes is terminated when said conductor line is broken or cut as a result of damage of said display panel.

2. A display device comprising a plurality of conductive elements formed on a breakable substrate, a conductor line provided on said substrate in a position where said line likely to break if said substrate breaks, means for supplying a high voltage to said conductive elements for giving a visual display on said substrate, means for applying a low voltage to one end of said conductor line, control means coupled to the other end of said conductor line and responsive to said low voltage transmitted to said other end of sAId conductor line via said conductor line for controlling the supply of said high voltage to said conductive elements, and means coupled to said high voltage supply means and to said control means for terminating the supply of said high voltage when said conductor line is broken and said low voltage is no longer transmitted to said other end of said conductor line, whereby an operator is protected from high voltage if said substrate breaks the conductor line thus terminating the supply of said high voltage.

3. The display panel of claim 2 wherein there are two of said substrates with conductive elements and with a sealed space between said substrates, said sealed space containing a substance which gives a display when subjected to the stress of a high voltage.

4. The display panel of claim 3 wherein the conductive elements on a first of said substrates are a plurality of spaced parellel lines extending in a first direction and the condcutive elements on a second of said substrates are a plurality of spaced parallel lines extending in a second direction which is perpendicular to said first direction, said substance glowing at the intersection of energized conductors on said two substrates.

5. The display panel of claim 4 wherein said conductor line is a strip of material printed on said substrate and surrounding said conductive elements on at least one of said substrates.

6. The display panel of claim 4 wherein some of the conductive elements on at least one of said substrates are energized on one end of said one substrate, and other of said conductive elements on said one substrate are energized on an opposite end of said one substrate, said conductor line comprises first and second conductive strips on opposite sides of said conductive elements on said one substrate, and a wire interconnecting said conductive strips externally to said substrate.

7. The display panel of claim 2 wherein said conductor line is a strip of conductive material on said substrate and surrounding at least some of said conductive elements.

8. The display panel of claim 2 wherein said conductor line is a pair of strips of conductive material on said substrate, said pair of strips being interconnected at one end by an external wire.

9. The display panel of claim 2 wherein said conductor line is a zigzag strip of conductive material on said substrate.

10. A process for displaying information on a breakable panel comprising the steps of:

(a) forming a plurality of electrically conductive strips on said panel for causing a display responsive to the energization if individual ones of said strips;

(b) forming a lead-in conductor on said panel in at least one location where said panel is likely to break if a sufficient force is applied thereto, whereby said lead-in conductor breaks if said panel breaks;

(c) supplying a voltage to energize selected one of said strips;

(d) supplying a low voltage to one end of said lead-in conductor;

(e) responding to a presence of said low voltage at the other end of said lead-in conductor for determining the continuity of the wire and the unbroken state of said panel; and (f) stopping the supply of said high voltage to said strips when said low voltage is absent at said other end of said lead-in conductor due to breakage of panel and said lead-in conductor, whereby an operator is protected against high voltage if said panel breaks.

* * * * *